US007827899B2

(12) United States Patent
Ravid et al.

(10) Patent No.: US 7,827,899 B2
(45) Date of Patent: Nov. 9, 2010

(54) ARMOR

(75) Inventors: Moshe Ravid, Hod Hasharon (IL); Mark Pak, Karmiel (IL); Shmuel Genihovich, Nazareth Ellite (IL)

(73) Assignee: Plasan Sasa Ltd., M. P. Marom Hagalil (IL)

( * ) Notice: Subject to any disclaimer, the term of this patent is extended or adjusted under 35 U.S.C. 154(b) by 76 days.

(21) Appl. No.: 11/979,163

(22) Filed: Oct. 31, 2007

(65) Prior Publication Data

US 2008/0264244 A1 Oct. 30, 2008

(30) Foreign Application Priority Data

Nov. 26, 2006 (IL) ..... 179592

(51) Int. Cl.
*F41H 1/02* (2006.01)

(52) U.S. Cl. ..... 89/36.05; 2/2.5

(58) Field of Classification Search ..... 89/36.05, 89/36.04; 2/2.5
See application file for complete search history.

(56) References Cited

U.S. PATENT DOCUMENTS

| | | | | |
|---|---|---|---|---|
| 4,422,183 | A * | 12/1983 | Landi et al. | 2/455 |
| 4,633,756 | A | 1/1987 | Rudoi | |
| 6,327,954 | B1 * | 12/2001 | Medlin | 89/36.08 |
| 6,389,594 | B1 * | 5/2002 | Yavin | 2/2.5 |
| 7,393,577 | B2 * | 7/2008 | Day et al. | 428/121 |
| 2002/0094406 | A1 | 7/2002 | Cohen | |
| 2004/0097608 | A1 | 5/2004 | Re'em | |
| 2004/0192127 | A1 | 9/2004 | Huarcaya-Pro | |
| 2008/0141428 | A1 * | 6/2008 | Kapah et al. | 2/2.5 |

FOREIGN PATENT DOCUMENTS

| | | | |
|---|---|---|---|
| EP | 1 293 429 | A1 * | 3/2003 |
| EP | 1 358 269 | B1 | 11/2003 |
| GB | 2 227 299 | A | 7/1990 |
| WO | WO 95/10751 | | 4/1995 |
| WO | WO 99/22195 | | 5/1999 |
| WO | 2005/119163 | A2 | 12/2005 |

* cited by examiner

*Primary Examiner*—Stephen M Johnson
(74) *Attorney, Agent, or Firm*—The Nath Law Group; Derek Richmond; Sung Yeop Chung

(57) ABSTRACT

An armor panel adapted to protect a body from an incoming projectile, the armor panel comprising an armor member constituted by at least one layer. The layer is encapsulated within and pressed upon by a wrapping as a result of an arresting process. The panel has a front, rear and side walls. The wrapping is preformed, prior to the process, with at least one outlet hole at least one of the rear and side walls. Through the outlet hole, air trapped within the armor panel prior to the arresting process, and/or excess gasses produced during the process, are allowed to escape.

6 Claims, 2 Drawing Sheets

ARMOR

FIELD OF THE INVENTION

This invention relates to armor panels, more particularly to armor panels comprising a plurality of layers.

BACKGROUND OF THE INVENTION

A standard armor panel of the kind to which the present invention refers, comprises a multitude of layers, designed to gradually absorb the kinetic energy of an impact, delivered to the panel by the incoming projectile and finally to avoid complete penetration of the projectile or its fragments through the armor. It can also stand against mechanical impacts of the plate.

The layers used in such armor panels may be divided into two groups: hard layers, e.g. steel or ceramic, and soft layers, e.g. Aramid or UHMW HDPE (Ultra High Molecular Weight High Density PolyEthylene). The harder layers are usually positioned facing the incoming projectile and absorb most of its kinetic energy, thereby slowing it down and shattering and/or deforming it substantially. The softer layers absorb the remains of the kinetic energy of the projectile, stopping it, and preventing it or its fragments from deforming/coming in contact with the body to be protected or at least from penetrating it.

The choice between various materials that may constitute the hard and/or soft layers of the armor panel is affected by the required end properties of the panel, such as ballistic properties, weight, etc. Thus, for example, a hard ceramic layer may be light-weight, yet brittle, while a hard steel layer having similar ballistic properties, may be very heavy, though easy to work with.

One example of an armor panel of the kind to which the present invention refers is disclosed in U.S. Pat. No. 6,389,594 to Israel Military Industries Ltd, which discloses an anti-ballistic article including a monolithic ceramic plate, an anti-ballistic backing material affixed to the ceramic monolith, and an outer shell formed of an antiballistic material, including a curable resin, enclosing the backing and ceramic monolith. The panel is produced by arranging the ceramic monolith and antiballistic backing inside the shell, immersing the shell in resin and then subjecting the entire structure to high temperature and pressure, due to which the resin is cured. After curing, the temperature is reduced letting the armor panel cool down, and afterwards the pressure is reduced, leaving the ceramic monolith "arrested" within the outer shell.

SUMMARY OF THE INVENTION

According to one aspect of the present invention there is provided an armor panel adapted to protect a body from an incoming projectile, said armor panel comprising an armor member constituted by at least one layer and encapsulated within and pressed upon by a wrapping as a result of an arresting process, said panel having front, rear and side walls and said wrapping being preformed, prior to said process, with at least one outlet hole at least one of the rear and side walls, through which air trapped within the armor panel prior to the arresting process, and/or excess gasses produced during said process, are allowed to escape.

The wrapping may be formed with a plurality of outlet holes, arranged so as to allow uniform escape of the air and excess gasses from the armor panel. The area of the outlet hole(s) preferably constitutes a minority of the area of the wall(s) in which it/they are formed.

The wrapping may be made of a variety of ballistic fabric, for example fabric prepreg comprising epoxy, Phenol, resin or the like reinforced with fibers, e.g. Aramid, Carbon, Fiberglass etc.

The armor member may comprise a front layer and a backing layer, said front layer facing the front side of said armor panel and said backing member facing said rear side of said armor panel.

The front layer may be made of a single ceramic monolith. According to one embodiment, the ceramic monolith is made of standard ceramic material, such as e.g. alumina. According to another embodiment, the ceramic monolith is made of a glass-ceramic material.

The use of glass-ceramics for purposes of protection against kinetic threats has been previously described, for instance, in WO2005/119163. However, incorporation of glass-ceramics in an armor panel configuration as described above surprisingly provides significant advantages. In particular, the glass-ceramic monolith in the armor panel according to the present application is adapted to provide a significantly smaller pulverization area around the impact point than that of a standard ceramic monolith. It may also provide a significantly shorter crack path, keeping the cracks from reaching the side walls of the panel.

This allows improving the multi-hit capability of the armor panel. This also allows using the wrapping as described above with said at least one outlet hole without deteriorating the improved multi-hit capability of the armor panel. The use of a glass-ceramics monolith also allows reducing the overall weight of the armor panel by at least 10% compared with a monolith made of Alumina or Silicon Carbide, providing the same ballistic affectivity. The use of Glass ceramics may also be cheaper in comparison with known materials such as Boron-Carbide, for example, B4C.

The backing layer may comprise a plurality of plies of ballistic fabric, for example s a plurality of Polyethylene layers or plurality of Aramid fiber layers, e.g. it may be made of Kevlar™.

The armor panel may be fitted with a shock absorbing member attached to the wrapping at the front wall of the armor panel, and adapted to protect said armor panel from mechanical deformation due to various hits and blows other than those of said incoming projectiles, without deteriorating its ballistic effectiveness. The shock absorbing member may also be helpful in reducing the amount of forward shrapnel caused to the armor panel by an incoming projectile. These effects of the shock absorbing member are specifically advantageous for the armor panel of the present invention due to the brittle characteristics of ceramic material, which may easily break upon fall or impact, and produces a substantially large amount of shrapnel as opposed to metal and steel material.

The shock absorbing member may be made of an energy absorbing material such as rubber, sponge or similar materials, e.g. such as disclosed in US2004/0097608A1, whose description is incorporated herein by reference. The incorporation of this member in an armor panel as described above provides said armor panel with surprisingly high resistance to non-projectile impact and deformations, at a low thickness, adding no more than 10% to the overall weight of the armor panel.

The shock absorbing material may, in particular, have a thickness ranging from 3 to 9 mm, and have an area mass ranging between 1.5-4 $Kg/m^2$. Furthermore, the material may have a shock absorbing power of 9-11%, according to the ASTM D1054 standard test method for Rubber Property Resilience as known per se.

The use of the shock absorbing member as described above in an armor panel constitutes another aspect of the present invention, in accordance with which there is provided an armor panel adapted to protect a body from an incoming projectile, said armor panel comprising an armor member having front and rear walls, and a shock absorbing layer adapted to protect said armor member from hits and blows other than those of said incoming projectiles; wherein said shock absorbing member is in front of said front wall of the armor member with respect to direction from which said projectile is expected, and constitutes no more that 10% of the total weight of said armor panel.

BRIEF DESCRIPTION OF THE DRAWINGS

In order to understand the invention and to see how it may be carried out in practice, several embodiments will now be described, by way of a non-limiting example only, with reference to the accompanying drawings, in which.

DETAILED DESCRIPTION OF EMBODIMENTS

Figure 1:
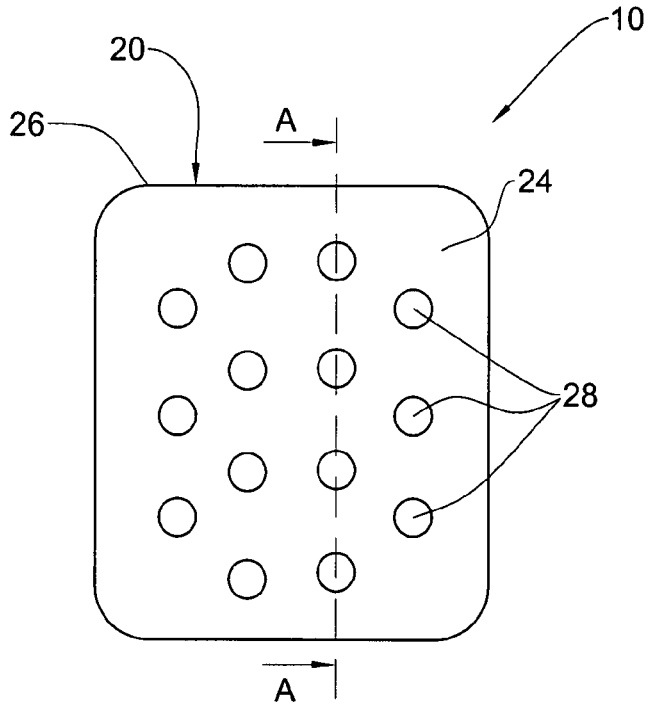
FIG. 1 is a schematic back view of an armor panel according to one example of the present invention.
Figure 2:
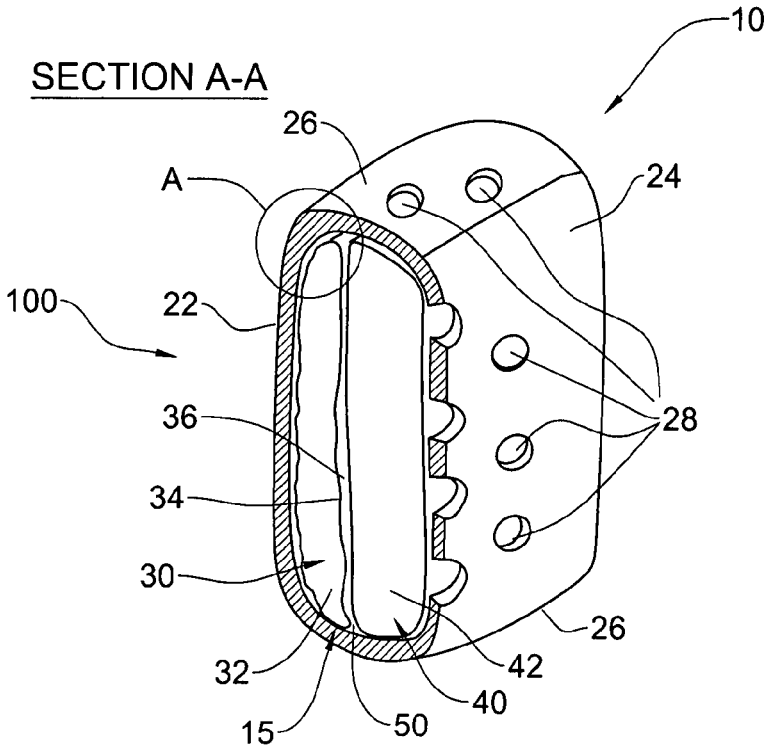
FIG. 2 is a schematic isometric section view along line A-A of the armor panel of FIG. 1 prior to the bonding.
Figure 3:
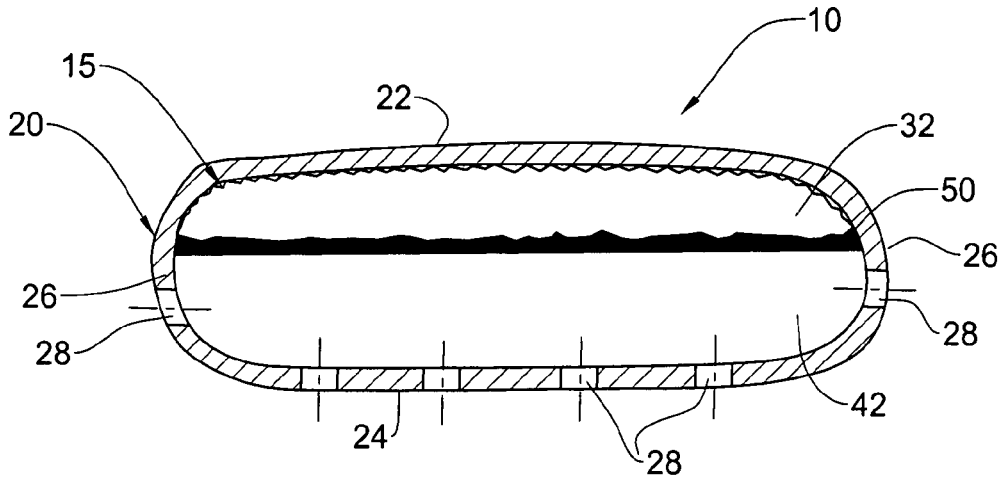
FIG. 3 is an enlarged view of a detail 'A' of FIG. 2.

FIGS. 1 to 3 illustrate an armor panel according to one example of the present invention, generally designated 10, which comprises an armor member 15 and a wrapping 20 which encapsulates and compresses the armor member 15 from all its sides. The armor panel 10 has a front wall 22 facing in the direction of arrow 100, indicating the direction of an incoming threat (not shown), a rear wall 24, facing a body to be protected (also not shown) and side walls 26, with the armor member 15 positioned therebetween.

The armor member 15 is a composite multilayer member and it provides the armor panel with desired ballistic effectiveness. The armor member 15 comprises a front plate 30 and a backing material 40. The front plate 30 is constituted by a single glass-ceramic monolith 32, to which the backing material 40 is attached by an adhesive layer 50. The monolith 32 has a surface 34 facing the backing material 40, which is essentially rough, e.g. about 0.16 to 0.2 μm, which is rougher than surfaces of a standard ceramic monolith. The backing material 40 is in the form of a plurality of Polyethylene layers 42.

The wrapping 20 is made of a curable prepreg, and has preformed outlet holes 28 on the rear wall 24 of the panel and on side walls 26.

The armor panel 10 is produced by first preparing the wrapping 20 and forming the outlet holes 28 therein. Also, an adhesive is introduced between the monolith 32 and the backing material 40. Then the wrapping 20 is arranged around the armor member 15 so as to fully encapsulate it, with the outlet holes 28 being disposed at the rear wall 24 and on side walls 26 of the armor panel 10.

Figure 4:
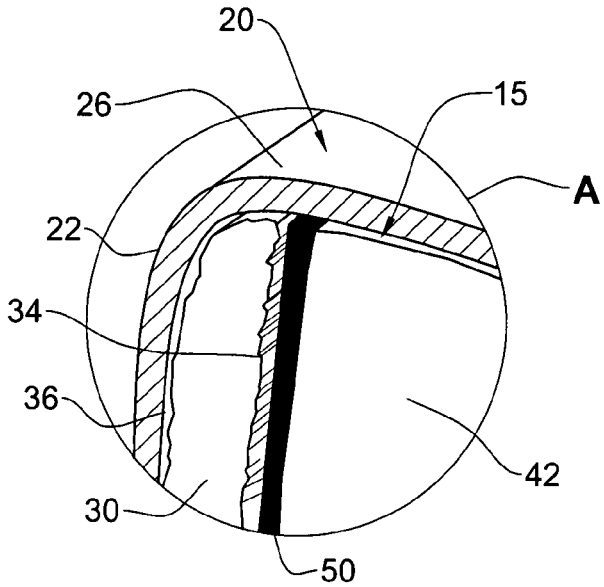
FIG. 4 is a schematic section view of the armor panel of FIG. 1 after bonding.
Figure 5:
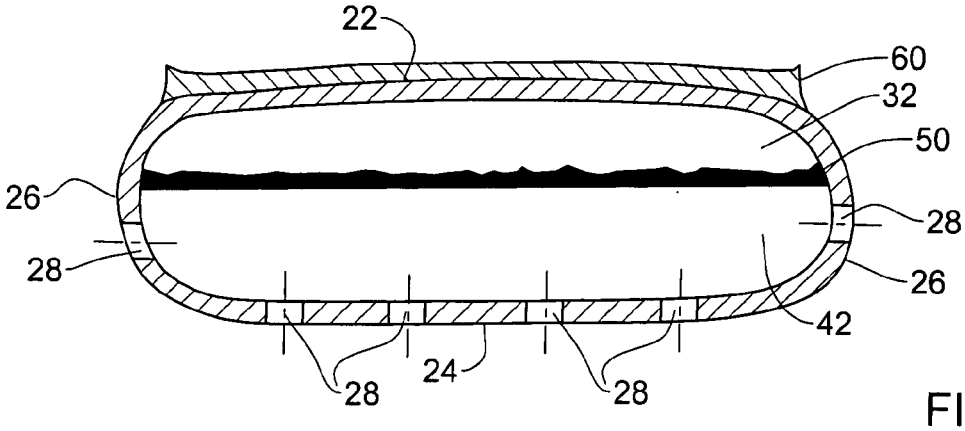
FIG. 5 is a schematic view of an armor panel of FIG. 4 in accordance with another example of the present invention.

Further, an arresting process is performed, in the course of which the monolith 32, the backing material 40 and the adhesive 50 therebetween, encapsulated in the wrapping 20 are subjected to elevated pressure and temperature which results in curing and subsequent shrinking of the prepreg from which the wrapping 20 is made. This causes the front plate 30 and backing material 40 to become firmly and tightly bonded to each other as shown in FIG. 4, and thereby forming the armor member 15, with the wrapping 20 bonded around said armor member 15 pressing thereupon. The pressure should be uniform and homogenous on all sides of the armor panel 10. This may be achieved by an autoclave, a hydroclave or by exposing the panel to isostatic pressure, which may range from about 1 to about 30 bars, depending on the substance used.

During the arresting process, the air in the "air pockets" 36 caused by the rough surface 34 of the monolith 32 becomes trapped inside the armor panel, along with exhaust gases caused by the arresting process. Furthermore, air and gas pockets are created in the panel during the pressing process due to pressure and temperature. These air and gases are allowed to escape the panel 10 through the outlet holes 28 formed in the rear wall 24 and on side walls 26 of the wrapping 20. Specifically, when the armor panel 10 is subjected to the above pressure, the air and gases trapped therein are squeezed outwardly towards the side walls 26 of the armor panel 10 and from there moves around the backing material 40 to reach the outlet holes 28. This is contrary to known panels which are formed without outlet holes, causing the air and gases to remain "imprisoned" within the panel, a phenomenon which makes the armor panel less uniform and may provide week spots in which the resistance of the armor panel to incoming threats is significantly reduced.

The location of the outlet holes 28 and their shape may vary, but their total area should preferably constitute up to 10% of the rear wall 24 and on side walls 26 area of the wrapping 20.

The armor panel 10 may further comprise a shock absorbing member 60 made of an energy absorbing material, attached to the front wall 22 of the wrapping 20 and adapted to protect the armor panel 10 from hits and blows other than those of an incoming projectile 72 (not shown).

For example, if the body to be protected is a vehicle, such hits and blows may be caused by the vehicle bumping into a wall, being involved in a car crash etc. in which case the armor panel 10 may be damaged. Alternatively, the armor panel 10 may simply detach from the body to be protected and smash into the ground, a person wearing the armor may suffer a severe fall, the armor may get stepped on etc. The shock absorbing member 60 absorbs such hits on one hand and will not reduce the effectiveness of the armor panel 10 on the other hand.

The shock absorbing material may be a Polyurethane rubber as described in with a thickness of 6.8±0.7 mm, a mass area weight of 1.5-4 $Kg/m^2$. The shock absorbing properties of the material range between 9-11% according to the ASTM D1054 standard test method for Rubber Property Resilience, as known per se. An armor member constituted by at least one layer and encapsulated within and pressed upon by a wrapping, and provided with such shock absorbing member appeared to be able to withstand 15 rounds of 50 J impacts at the same point.

Those skilled in the art to which this invention pertains will readily appreciate that numerous changes, variations, and modifications can be made without departing from the scope of the invention, mutatis mutandis.

The invention claimed is:

1. An armor panel configured to protect a body from an incoming projectile, said armor panel comprising an armor member, wherein the armor member is constituted by at least one layer, wherein the armor member is encapsulated within and pressed upon by a wrapping as a result of an arresting process, wherein said panel has a front face, a rear face and side walls extending therebetween, the rear face being configured for facing the body, and the front face being located opposite to the rear face, said wrapping being preformed prior to said process, with at least one outlet hole at least one of the rear and side walls, through which air trapped within the armor panel prior to the arresting process, and/or excess gasses produced during said process, are allowed to escape, wherein the front face is free of outlet holes, and wherein the wrapping is made of a ballistic material made of a fiber reinforced pre-preg.

2. The armor panel according to claim 1, wherein said prepreg comprises at least one material selected from the group consisting of epoxy, resin, and phenol.

3. The armor panel according to claim 1, wherein said fibers comprise at least one material selected from the group consisting of aramid, carbon, and fiberglass.

4. The armor panel according to claim 1, wherein said wrapping is formed with a plurality of outlet holes.

5. The armor panel according to claim 4, wherein said plurality of holes is arranged to allow uniform escape of air and excess gasses from the armor panel.

6. The armor panel according to claim 4, wherein the area of said plurality of outlet holes constitutes a minority of the face in which they are formed.

* * * * *